US008959808B2

(12) United States Patent
Uno et al.

(10) Patent No.: US 8,959,808 B2
(45) Date of Patent: Feb. 24, 2015

(54) THREE-DIMENSIONAL GREETING CARD AND PROTECTIVE CASE THEREFOR

(75) Inventors: Nobuaki Uno, Tokyo (JP); Susumu Hashimoto, Tokyo (JP); Kenji Nishioka, Tokyo (JP); Toshiki Akiyama, Tokyo (JP)

(73) Assignee: Kowabo Company, Ltd., Aichi (JP)

( * ) Notice: Subject to any disclaimer, the term of this patent is extended or adjusted under 35 U.S.C. 154(b) by 0 days.

(21) Appl. No.: 13/262,852

(22) PCT Filed: Nov. 24, 2009

(86) PCT No.: PCT/JP2009/006296
§ 371 (c)(1),
(2), (4) Date: Dec. 14, 2011

(87) PCT Pub. No.: WO2011/010353
PCT Pub. Date: Jan. 27, 2011

(65) Prior Publication Data

US 2012/0090205 A1 Apr. 19, 2012

(30) Foreign Application Priority Data

Jul. 21, 2009 (JP) ..... 2009-169782

(51) Int. Cl.
*G09F 1/00* (2006.01)
*B42D 15/04* (2006.01)
(Continued)

(52) U.S. Cl.
CPC ..... *B42D 15/045* (2013.01); *G09F 1/10* (2013.01); *G09F 1/00* (2013.01); *G09F 1/06* (2013.01); *A47G 1/14* (2013.01)
USPC ..... 40/124.01; 40/124.06; 40/124.08; 40/661; 40/124.16; 40/124.17; 40/124.18; 40/781; 206/45.24

(58) Field of Classification Search
CPC ..... G09F 1/00; G09F 1/06; G09F 1/10
USPC ..... 40/124.01, 124.06, 124.08, 661, 40/124.16, 124.17, 124.18, 781; 206/45.24
See application file for complete search history.

(56) References Cited

U.S. PATENT DOCUMENTS 2,747,311 A * 5/1956 Fulmer ..... 40/781
3,897,645 A * 8/1975 Scheyer ..... 40/800
(Continued)

FOREIGN PATENT DOCUMENTS

JP 07052585 2/1996
JP 10157347 6/1998
(Continued)

OTHER PUBLICATIONS

International Search Report in PCT/JP2009/006296, Mar. 2, 2010.
(Continued)

*Primary Examiner* — Syed A Islam
(74) *Attorney, Agent, or Firm* — Bacon & Thomas, PLLC

(57) ABSTRACT

Provided is a greeting card which provides a three-dimensional effect and enables the change of the layout of a picture. Also provided is a protective case for a greeting card which enables the greeting card to be viewed in a standing state. Specifically, provided is a three-dimensional greeting card including a picture part formed in at least part of a greeting card body, the picture part being configured by sticking an appropriate number of constituent picture pieces on top of one another. Also specifically, provided is a protective case for a greeting card, including a transparent plastic case body including upper and lower openings, the protective case further including: a protruding piece for forming a foot part, the protruding piece being formed at the lower opening so as to be outwardly bendable; and a protruding piece for forming a greeting card receiving part, the protruding piece being formed at the lower opening so as to be inwardly bendable.

6 Claims, 6 Drawing Sheets

(51) Int. Cl.

| | |
|---|---|
| ***A47G 1/14*** | (2006.01) |
| *G09F 1/10* | (2006.01) |
| *G09F 1/06* | (2006.01) |

(56) References Cited

U.S. PATENT DOCUMENTS

| | | | | |
|---|---|---|---|---|
| 3,977,112 | A * | 8/1976 | Breer, II | 40/760 |
| 7,013,591 | B2 * | 3/2006 | Lee | 40/800 |
| 2009/0214802 | A1 * | 8/2009 | Sedlacko | 428/7 |

FOREIGN PATENT DOCUMENTS

| | | |
|---|---|---|
| JP | 3087508 | 5/2002 |
| JP | 2004091994 | 3/2004 |
| JP | 2006289922 | 10/2006 |

OTHER PUBLICATIONS

Written Opinion of ISA in PCT/JP2009/006296, Mar. 2, 2010.

* cited by examiner

THREE-DIMENSIONAL GREETING CARD AND PROTECTIVE CASE THEREFOR

FIELD OF THE INVENTION

The present invention relates to a three-dimensional greeting card and a protective case therefor.

BACKGROUND OF THE INVENTION

A greeting card is widely utilized for: celebration of a birthday and entrance into a school; invitation to social gathering and a welcome/farewell party; announcement of opening of a shop and a change of address; and the like.

Then, the conventional greeting card generally includes a picture part and a message space part. The picture part simply has a mere two-dimensional picture (see, for example, Patent Document 1), thus resulting in a problem that a three-dimensional effect cannot be obtained. Moreover, the picture is printed, and hence is completely impossible for a person who receives the greeting card to change the layout of the picture.

In addition, the conventional greeting card is a card made of thin paper, and hence it is necessary in actuality to utilize a picture stand and the like in order to store or view the card.

PRIOR ART DOCUMENT

Patent Document

[Patent Document 1] JP-A-07-52585

SUMMARY OF THE INVENTION

The present invention has been made in view of the conventional problem and actuality as described above, and therefore has an object to provide a greeting card which provides a three-dimensional effect and enables the change of the layout of a picture.

Also, the present invention has an object to provide a protective case for a greeting card which is suitably used for transporting or storing the greeting card, and more particularly, a protective case which enables the greeting card to be viewed in a standing state without using a picture stand.

In order to achieve the above-mentioned objects, the present invention provides a three-dimensional greeting card including a picture part formed in at least part of a greeting card body, the picture part being configured by sticking an appropriate number of constituent picture pieces on top of one another.

In addition, in order to achieve the above-mentioned objects, the present invention provides the three-dimensional greeting card, in which the constituent picture pieces are stuck on top of one another so as to be detachably attached by a sheet fastener.

In addition, in order to achieve the above-mentioned objects, the present invention provides a protective case for a greeting card, including a transparent plastic case body including upper and lower openings, the protective case further including: a protruding piece for forming a foot part, the protruding piece being formed at the lower opening so as to be outwardly bendable; and a protruding piece for forming a greeting card receiving part, the protruding piece being formed at the lower opening so as to be inwardly bendable.

In addition, in order to achieve the above-mentioned objects, the present invention provides the protective case for a greeting card, further including a protruding piece for forming a greeting card engaging part, the protruding piece being formed at the upper opening of the transparent plastic case body so as to be inwardly bendable.

In addition, in order to achieve the above-mentioned objects, the present invention provides a three-dimensional greeting card including the greeting card housed in the protective case.

With the three-dimensional greeting card according to the present invention, a viewer can view the picture part with a three-dimensional effect being provided. In particular, if an embodiment in which the constituent picture piece is detachably attached by the sheet fastener is adopted, a person who receives the greeting card can freely change the layout of the picture part.

In addition, with the protective case according to the present invention, the three-dimensional greeting card having a thickness can be housed to be safely transported or stored. Further, the greeting card can be displayed in a standing state, and thus can be viewed without particularly using a picture stand and the like.

DESCRIPTION OF THE INVENTION

Hereinafter, an embodiment of the present invention is described with reference to the drawings.

Figure 1:
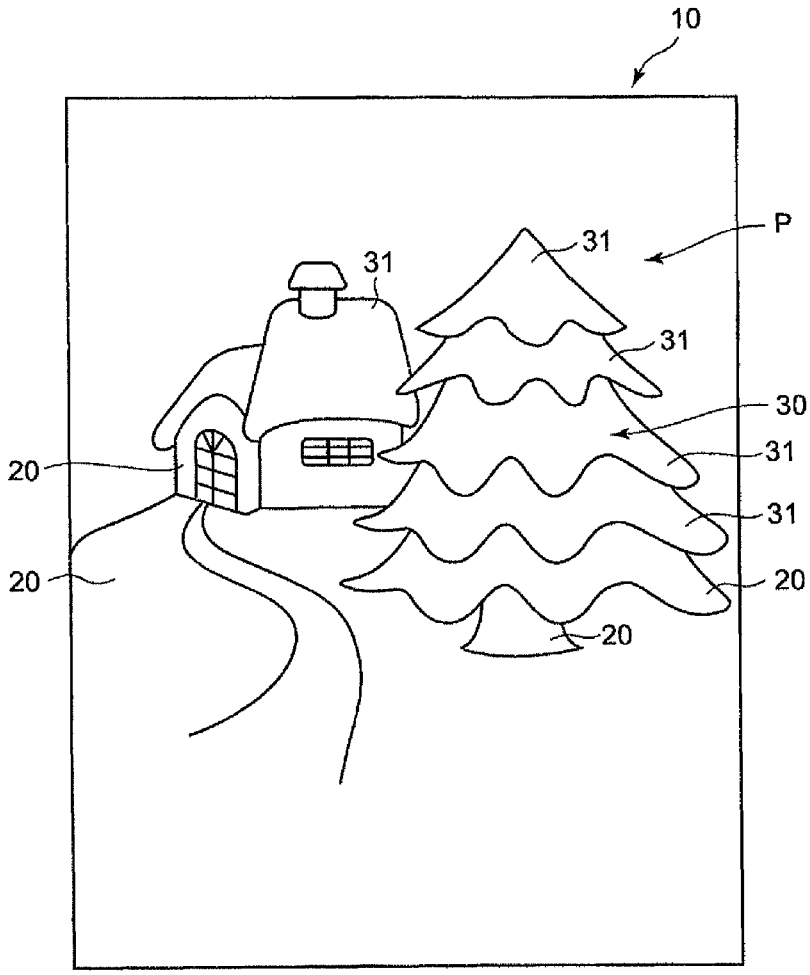
FIG. 1 is an explanatory plan view schematically illustrating a three-dimensional greeting card according to the present invention.
Figure 2:
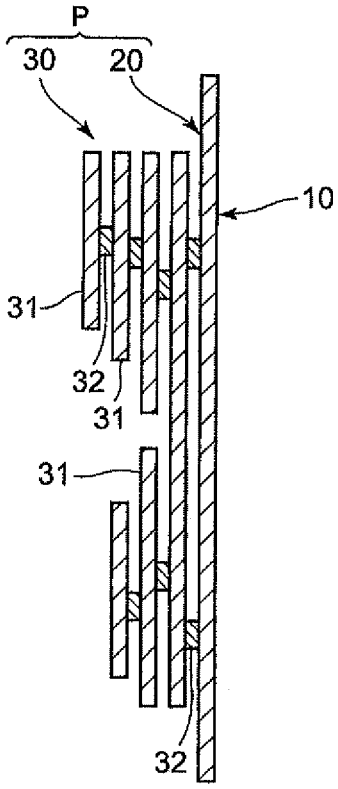
FIG. 2 is an explanatory cross-sectional view schematically illustrating the three-dimensional greeting card according to the present invention.
Figure 3:
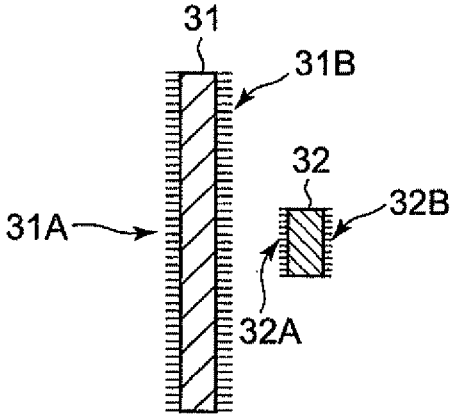
FIG. 3 is an explanatory cross-sectional view schematically illustrating a constituent picture piece and a spacer.

FIG. 1 is an explanatory plan view schematically illustrating a three-dimensional greeting card according to the present invention, and FIG. 2 is an explanatory cross-sectional view schematically illustrating the same. FIG. 3 is an explanatory cross-sectional view schematically illustrating a constituent picture piece and a spacer.

In FIG. 1 to FIG. 3, 10 denotes a greeting card body. A picture part P is formed on a front surface of the greeting card body 10, and a message space (not illustrated) is formed on a rear surface thereof.

The picture part P includes a two-dimensional picture part 20 and a three-dimensional picture part 30. The two-dimensional picture part 20 is displayed by printing and the like on the surface of the greeting card body 10. In addition, the three-dimensional picture part 30 is configured by sticking, for each part, an appropriate number of constituent picture pieces 31 on top of one another, the constituent picture pieces 31 being formed for each part corresponding to each part of the two-dimensional picture part 20. Note that, the specific size and shape of the constituent picture piece 31 is determined as appropriate in accordance with a picture design and the like.

When the constituent picture pieces 31 are stuck on top of one another, it is more desirable to interpose a spacer 32 therebetween as appropriate. This is because even a small number of constituent picture pieces stuck on top of one another can provide a three-dimensional effect.

In addition, as illustrated in FIG. 3, it is more desirable that sheet fastener parts 31A, 31B and 32A, 32B be respectively formed on front and rear surfaces of the constituent picture piece 31 and the spacer 32, whereby the constituent picture piece 31 and the spacer 32 are detachably attached to each other. With this configuration, the layout of the picture part P can be changed.

Figure 4:
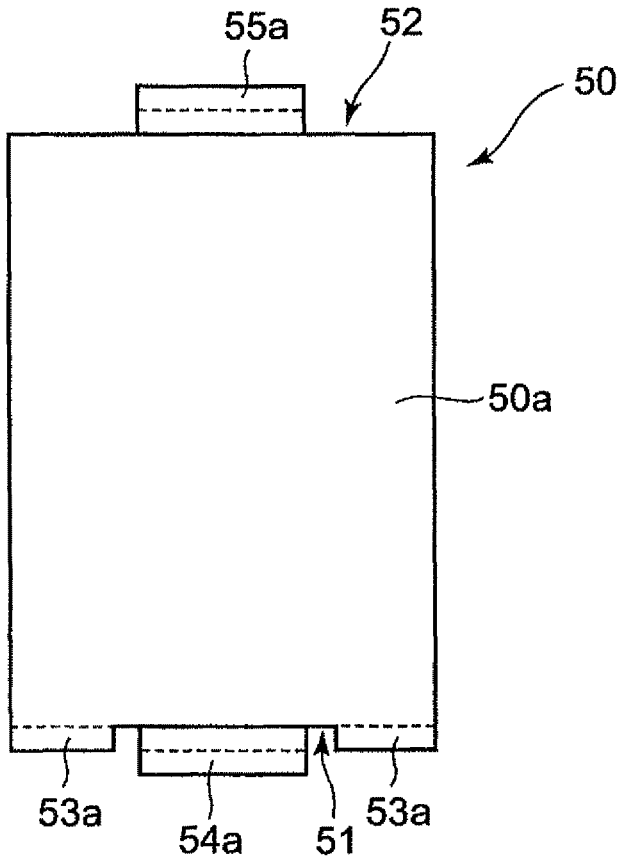
FIG. 4 is an explanatory front view schematically illustrating a protective case according to the present invention.
Figure 5:
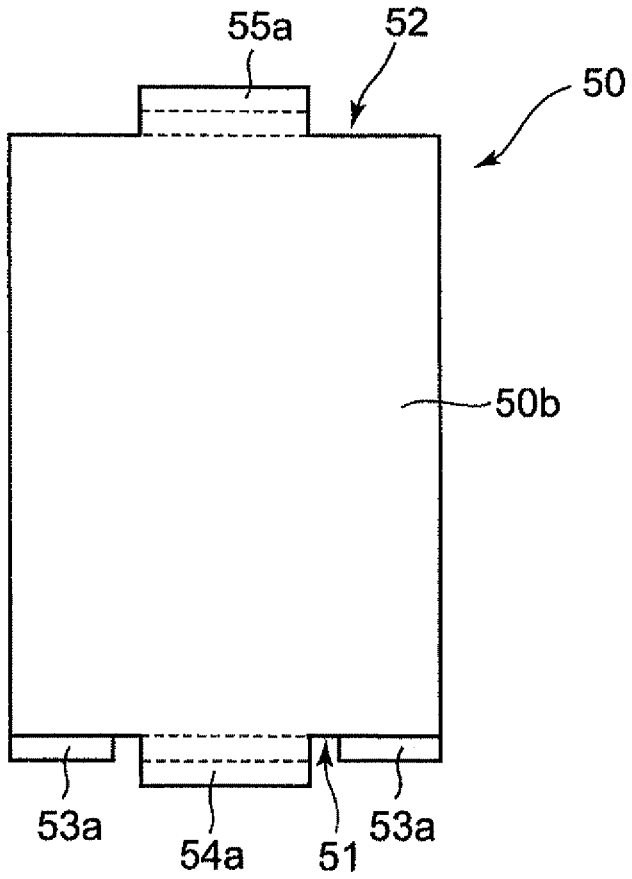
FIG. 5 is an explanatory rear view schematically illustrating the protective case according to the present invention.
Figure 6:
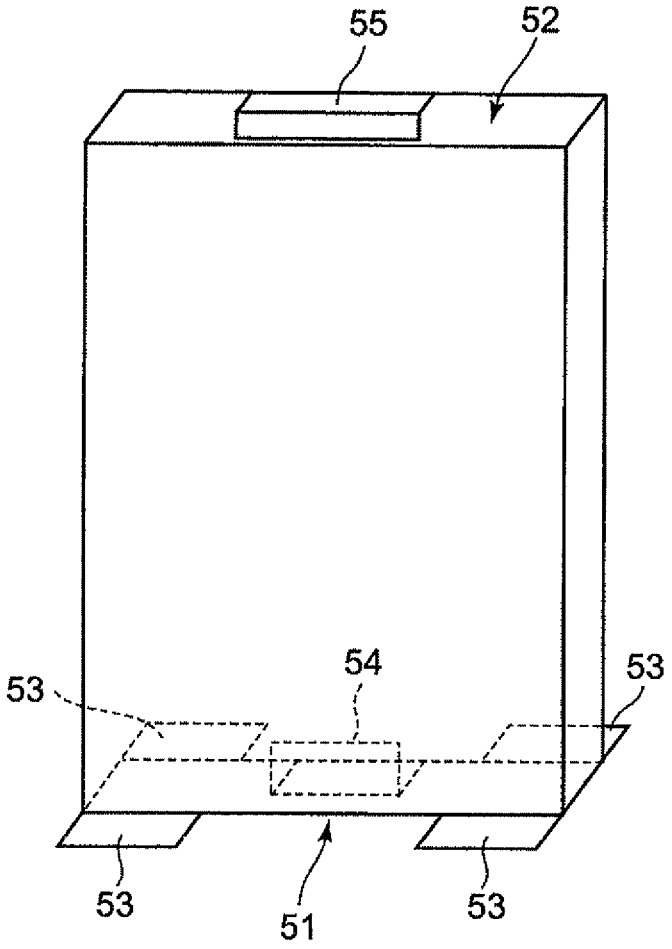
FIG. 6 is an explanatory perspective view schematically illustrating a state where the greeting card is housed to be stood in the protective case according to the present invention.
Figure 7:
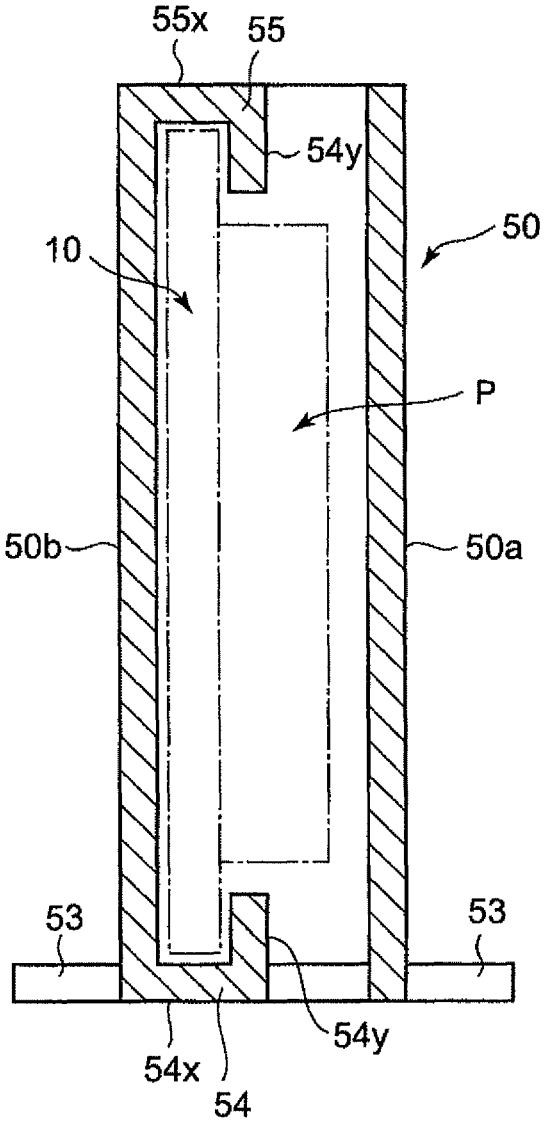
FIG. 7 is an explanatory cross-sectional view schematically illustrating the state where the greeting card is housed to be stood in the protective case according to the present invention.

FIG. 4 is an explanatory front view schematically illustrating a protective case for a greeting card according to the present invention, and FIG. 5 is an explanatory rear view schematically illustrating the same. FIG. 6 is an explanatory perspective view schematically illustrating a state where the greeting card is housed to be stood in the protective case, and FIG. 7 is an explanatory cross-sectional view schematically illustrating the same.

In FIG. 4 to FIG. 7, 50 denotes a transparent plastic case body having a rectangular tube shape, and the case body 50 includes a lower opening 51 and an upper opening 52. A protruding piece 53*a* for forming a foot part is formed at the lower opening 51 of the case body 50 so as to be outwardly bendable. No particular limitation is imposed on the number of the protruding pieces 53*a* for forming the foot part. It is preferable to provide, for example, four protruding pieces 53*a* in total, that is, two on both sides of a front wall part 50*a* of the case body 50 and two on both sides of a rear wall part 50*b* thereof. This is because four foot parts 53 can be obtained by outwardly bending them as illustrated in FIG. 6, leading to a stable standing state.

In addition, a protruding piece 54*a* for forming a greeting card receiving part is formed on a rear wall part 50*b* at the lower opening 51 of the case body 50 so as to be inwardly bendable. As illustrated in FIG. 7, a lower end receiving part 54 for the card body 10 is formed by inwardly bending the protruding piece 54*a*, and when the greeting card is housed inside, the lower end receiving part 54 serves to prevent the greeting card from falling through the lower opening 51. The lower end receiving part 54 may be formed of only a horizontal receiving part by inwardly bending it once, and it is desirable that the lower end receiving part 54 is formed of a horizontal receiving part 54*x* and a vertical receiving part 54*y* by inwardly bending them twice. This is because the lower end of the card body 10 is inserted into a recess portion formed by the rear wall part 50*b* of the case body 50, the horizontal receiving part 54*x*, and the vertical receiving part 54*y*, thereby it can be held and fixed more stably.

Meanwhile, a protruding piece 55*a* for forming a greeting card engaging part is formed on the rear wall part 50*b* at the upper opening 52 of the case body 50 so as to be inwardly bendable. As illustrated in FIG. 7, an upper end engaging part 55 for the card body 10 is formed by inwardly bending the protruding piece 55*a*, and when the greeting card is housed inside, the upper end engaging part 55 serves to prevent the greeting card from falling through the upper opening 52. Similarly to the lower end receiving part 54, it is desirable that the upper engaging part 55 be formed of a horizontal engaging part 55*x* and a vertical engaging part 55*y* by bending them twice, in order to hold and fix the upper end of the card body 10 more stably.

Note that, a specific method of forming the case body 50 itself is not limited, and it is desirable that each bent part of the case body 50 is subjected as appropriate to an embossing, a half-cutting and other processes, because a bending process is facilitated.

In the case where the three-dimensional greeting card according to the present invention is housed in such a protective case as described above to be transported or stored, first, the card body 10 including the picture part P is inserted from the upper opening 52 or the lower opening 51 of the case body 50. Next, the protruding piece 54*a* for forming the greeting card receiving part and the protruding piece 55*a* for forming the greeting card engaging part are inwardly bent in the appropriate order, to form the receiving part 54 and the engaging part 55, so that the lower end and the upper end of the card body 10 are held and fixed. In this case, if the protruding piece 53*a* for forming the foot part is outwardly bent to form the foot part 53, the foot part 53 protrudes from the case body 50, and such a protruding state is not suitable for packing. Accordingly, it is preferable to transport the three-dimensional greeting card housed in the protective case without outwardly bending the protruding piece 53*a*.

In this way, the use of the protective case according to the present invention enables safe transportation and storage of the three-dimensional greeting card having a thick body without impairing it.

In the meantime, a person who receives the greeting card outwardly bends the protruding piece 53*a* for forming the foot part to form the foot part 53, whereby it can be viewed in a standing state.

Moreover, in the case where the constituent picture piece 31 is detachably attached by the sheet fastener, the layout of the picture part P can be changed depending on his/her taste.

REFERENCE SIGNS LIST

P: picture part
10: card body
20: two-dimensional picture part
30: three-dimensional picture part
31: constituent picture piece
31A, 31B: sheet fastener part
32: spacer
32A, 32B: sheet fastener part
50: case body
50*a*: front wall part
50*b*: rear wall part
51: lower opening
52: upper opening
53: foot part
53*a*: protruding piece for forming foot part
54: receiving part
54*a*: protruding piece for forming receiving part
54*x*: horizontal receiving part
54*y*: vertical receiving part
55: engaging part
55*a*: protruding piece for forming engaging part
55*x*: horizontal engaging part
55*y*: vertical engaging part

The invention claimed is:

1. A three-dimensional greeting card assembly comprising:

a greeting card body having a flat body and a two-dimensional picture part formed on at least a part of the flat body;

a three-dimensional picture part formed on at least part of the greeting card body, the three-dimensional picture part being configured in a way such that an appropriate number of constituent picture pieces are connected on top of one another so as to be detachably attached by a sheet fastener; and a protective case configured to house the greeting card body and three-dimensional picture part, said protective case being a separate element from the greeting card body, and comprising a transparent plastic case body including a front wall part, a rear wall part and upper and lower openings, said transparent plastic case body having a first protruding piece being configured to form a foot part at a lower part of the front wall part and rear wall part thereof, by outwardly bending; a second protruding piece being configured to form a greeting card body receiving part at a lower part of the rear wall part thereof, having a horizontal receiving part and a vertical receiving part by inwardly and then upwardly bending; and a third protruding piece being configured to form an upper end engaging part of the greeting card body at the upper end of the rear wall part thereof, having a horizontal engaging part and a vertical engaging part by inwardly and then downwardly bending;

wherein said protective case is configured in a way such that the second and third protruding pieces engage the greeting card body so that the protective case houses the three-dimensional greeting card, and wherein said protective case is configured so that the three-dimensional greeting card is transportable in a storage state and viewable in the storage state or a standing state.

2. The three-dimensional greeting card assembly according to claim 1, wherein a gap is formed between the horizontal receiving part and vertical receiving part of the second protruding piece and the front wall part of the transparent plastic case when the second protruding piece engages the greeting card body.

3. The three-dimensional greeting card assembly according to claim 1, wherein a gap is formed between the horizontal engaging part and vertical engaging part of the third protruding piece and the front wall part of the transparent plastic case when the third protruding piece engages the greeting card body.

4. The three-dimensional greeting card assembly according to claim 1, wherein the second protruding piece has a width less than a width of the rear wall part.

5. The three-dimensional greeting card assembly according to claim 1, wherein the third protruding piece has a width less than a width of the rear wall part.

6. The three-dimensional greeting card assembly according to claim 1, wherein said first protruding piece is further configured to maintain said lower opening after said inwardly and then upwardly bending.

* * * * *